US007954904B2

(12) United States Patent
Mundry et al.

(10) Patent No.: US 7,954,904 B2
(45) Date of Patent: Jun. 7, 2011

(54) SHEARER LOADER FOR UNDERGROUND MINING COMPRISING A SPRAY SYSTEM

(75) Inventors: Sebastian Mundry, Ludinghausen (DE); Rainer Marek, Lunen (DE); Johannes Wesselmann, Dortmund (DE)

(73) Assignee: Bucyrus Europe GmbH, Lünen (DE)

( * ) Notice: Subject to any disclaimer, the term of this patent is extended or adjusted under 35 U.S.C. 154(b) by 149 days.

(21) Appl. No.: 12/377,141

(22) PCT Filed: Aug. 17, 2007

(86) PCT No.: PCT/EP2007/007287
§ 371 (c)(1),
(2), (4) Date: Feb. 11, 2009

(87) PCT Pub. No.: WO2008/019866
PCT Pub. Date: Feb. 21, 2008

(65) Prior Publication Data

US 2010/0237683 A1 Sep. 23, 2010

(30) Foreign Application Priority Data

Aug. 18, 2006 (DE) ..... 10 2006 038 939

(51) Int. Cl.
*E21C 35/23* (2006.01)

(52) U.S. Cl. ..... 299/81.2; 299/81.1; 299/43

(58) Field of Classification Search ..... 299/42, 299/43, 39.1, 39.4, 1.6, 81.1, 81.2, 81.3
See application file for complete search history.

(56) References Cited

U.S. PATENT DOCUMENTS

| | | | | |
|---|---|---|---|---|
| 3,096,082 | A * | 7/1963 | Long | 299/10 |
| 3,784,256 | A * | 1/1974 | Katlic | 299/43 |
| 3,980,338 | A * | 9/1976 | Weber | 299/43 |
| 4,072,355 | A * | 2/1978 | Pentith | 299/43 |
| 4,272,129 | A * | 6/1981 | Pearey | 299/43 |
| 4,453,774 | A * | 6/1984 | Knorr | 299/42 |

(Continued)

FOREIGN PATENT DOCUMENTS

DE 30 20 046 A1 12/1981

(Continued)

OTHER PUBLICATIONS

International Search Report for PCT/EP2007/007287.

(Continued)

*Primary Examiner* — Frederick L Lagman
(74) *Attorney, Agent, or Firm* — Rankin, Hill & Clark LLP

(57) ABSTRACT

A shearer loader for underground mining, the shear loader comprising a shearer loader body, at least one cutting drum fastened to a supporting arm joined to the loader body, a first drive motor for moving the shearer loader and a second drive motor for moving the cutting drums, a cooling water circuit for cooling the first and second drive motors, the cooling water circuit including an inlet and a return line, a spray system including at least one spray water circuit, the spray system including a feed line fluidly connecting a common water connection to the cutting drums, the spray system further including a valve in the feed line for switching the spray water circuits on and off, a control valve connected between the feed line of the spray water circuit and the return line of the cooling water circuit, the control valve allowing selective flow from the cooling water circuit to be directed to the cutting drums.

24 Claims, 2 Drawing Sheets

U.S. PATENT DOCUMENTS

| | | | | |
|---|---|---|---|---|
| 4,471,998 | A * | 9/1984 | Hotger | 299/81.2 |
| 4,691,967 | A * | 9/1987 | Schupphaus | 299/81.2 |
| 4,753,484 | A * | 6/1988 | Stolarczyk et al. | 299/30 |
| 4,896,920 | A * | 1/1990 | Weber et al. | 299/42 |
| 4,921,306 | A * | 5/1990 | Tomlin | 299/81.2 |
| 5,054,858 | A * | 10/1991 | Harrison | 299/81.2 |
| 5,114,213 | A * | 5/1992 | Kornecki et al. | 299/81.2 |
| 5,507,565 | A * | 4/1996 | LeBegue et al. | 299/81.2 |
| 2004/0036346 | A1 * | 2/2004 | Johannes Klaasse | 299/39.2 |
| 2007/0158995 | A1 * | 7/2007 | Suilmann et al. | 299/81.2 |
| 2008/0116734 | A1 * | 5/2008 | Bechem et al. | 299/85.1 |

FOREIGN PATENT DOCUMENTS

| | | | |
|---|---|---|---|
| DE | 32 25 664 | A1 | 1/1984 |
| DE | 36 26 135 | A1 | 2/1988 |
| DE | 87 15 561 | U1 | 2/1988 |
| DE | 37 01 063 | A1 | 7/1988 |
| DE | 38 05 659 | A1 | 9/1989 |
| DE | 195 37 448 | A1 | 5/1996 |

OTHER PUBLICATIONS

English Abstract for DE 38 05 659 A1 to Eickhoff Maschinenfabrik.
English Abstract for DE 195 37 448 A1 to Tiefenbach GmbH.
English Abstract for DE 37 01 063 A1 to Gewerk Eisenhuette Westfalia.
English Abstract or DE 3626135 to Eickhoff Maschinenfabrik.
English Abstract for DE 32 25 664 A1 to Ruhrkohle AG.
English translation of the International Preliminary Report on Patentability and Written Opinion dated Mar. 17, 2009 of International Appln. No. PCT/EP2007/007287, filed Aug. 17, 2007.

* cited by examiner

SHEARER LOADER FOR UNDERGROUND MINING COMPRISING A SPRAY SYSTEM

This application claims priority to and the benefit of the filing date of International Application No. PCT/EP2007/007287, filed Aug. 17, 2007, which application claims priority to and the benefit of the filing date of German Application No. 10 2006 038939.5, filed Aug. 18, 2006, both of which are hereby incorporated by reference into the specification of this application.

BACKGROUND

The invention relates to a shearer loader for underground mining, comprising a shearer loader body, comprising a respective cutting drum, fastened to a supporting arm, for each direction of travel of the shearer loader, comprising drive motors for moving the shearer loader and for moving the cutting drums, comprising at least one cooling water circuit for cooling the drive motors, comprising a spray system which comprises a spray water circuit having a respective feed line to the tools of the cutting drums, comprising a preferably common water connection for the water circuits, and comprising valves assigned to the water circuits for switching the water circuits on or off.

In the underground winning of minerals, in particular in underground coal winning, the spraying of spray water via nozzles onto the working face to be worked is prescribed for the suppression of dust. In this case, the longwall spraying is largely effected by means of the powered support assemblies, to which nozzles are attached at suitable points, such as the canopies for example, and these nozzles can be operated with high-pressure water at about 150-200 bar. Reference is made only by way of example to DE 195 37 448 A1.

With the increase in output effected in shearer loaders, the generation of dust and the risk of explosion in cutting operations increase. Whereas initially the cutting drums were sprayed from outside via water nozzles from the supporting arm, internal spraying, in which a water nozzle which can be supplied with spray water is assigned to each tool at the cutting drum, is also taking place in the meantime. The picks are sprayed at pressures of up to about 50 bar.

The lower water consumption of the spray systems which is achieved by the internal spraying in the meantime enables some of the cooling water to be directed away from longwall again in hoses via the cable trailing chain (cf. www-.steinkohleportal.de).

DE 30 200 46 A1 discloses a shearer loader in which the water fed to the shearer loader is divided at a line branch point into a line branch for the cooling water circuit and a line branch for the spray water circuit, wherein both line branches are fed, downstream of the units to be cooled in the water circuit and downstream of volume regulating valves in both sub-circuits, to a 4/3-way directional valve in order to be able to carry out the spraying, as a function of the direction of travel of the shearer loader, at the respectively leading cutting drum solely with the water flowing in from the spray water circuit and at the trailing cutting drum solely with the water fed to the cooling water circuit. Since less dust to be controlled by means of the spraying collects at the trailing drum, the spraying at the trailing drum is to be effected only with the lower water volume from the cooling water circuit.

SUMMARY OF THE INVENTION

The object of the invention is to improve the effectiveness of the water supply systems of shearer loaders.

To achieve this and other objects, it is proposed according to the invention that, in shearer loaders of the generic type, a respective control valve connected to one of the feed lines be arranged in return lines of the cooling water circuit, via which control valve the cooling water can be fed as spray water to the cutting drums as and when required. In the shearer loader according to the invention, the cooling water can therefore be fed, as and when required, to the spray nozzles at the cutting drums by opening the control valves and can be used there as spray water. An effective spray water supply which can be adapted to the respective ventilating conditions and mining conditions can therefore be provided at an overall lower requisite water flow rate for the shearer loader. Since the cooling water is fed to the cutting drums only as and when required, floor lift can at the same time be avoided to the greatest possible extent and it is no longer necessary to pump excess spray water away from the longwall.

In a preferred configuration according to the invention, a separate control valve is provided for each cutting drum. It is especially advantageous if both control valves are each connected via an intermediate line to the associated feed line for one of the cutting drums, each feed line preferably being provided, upstream of the inflow to the intermediate line, with a valve for separately switching the spray water circuit on and off and also preferably with a volume regulating valve. In this configuration, firstly the water volume fed to the cutting drums solely via the spray water circuit can be set via the volume regulating valve and secondly it is ensured that, if need be, in the event of excess accumulation of dust, both the spray water from the spray water circuit and the cooling water from the cooling circuit can be fed as spray water to the cutting drums.

Furthermore, a respective volume regulating valve can preferably be arranged in the intermediate lines and/or in the cooling water feed lines of some of or if need be of all the drive motors, to be cooled with the cooling water from the cooling water system, in order to be able to regulate in as optimum a manner as possible the water volume received and possibly delivered to the spray system. It is especially advantageous when some of or all the volume regulating valves can be activated or regulated for metered admission of spray water to the cutting drums. The activation can be effected, for example, via a primary activating unit, such as, for example, the longwall face control or the like.

A pressure limiting valve and/or a pressure regulating valve is expediently arranged downstream of the water connection in the common water feed to both water circuits in order to detect or avoid malfunctions due to the water volume, possibly established by the mines, and the water pressure for the spraying exceeding or falling below the threshold values. For example, in the event of a water supply that is too low, a limit value in relation to dust protection could be exceeded, for which reason the winning machine should be switched off or reduced in its output if this hazard situation is detected. Exceeding or falling below a threshold value may at the same time indicate obstruction of the nozzles or other malfunctions. In order to reliably detect this, it is also expedient if a volumetric flow sensor is arranged upstream of the pressure limiting valve. In order to avoid contamination of the circuits and clogging of the nozzles, it is also advantageous if a water filter, preferably a reversible flow filter, is arranged in the water feed upstream of the volumetric flow sensor. Furthermore, it is expedient if a branch point is formed downstream of the pressure limiting valve, said branch point opening with one branch into the cooling water circuit and with one or preferably two branch lines into separate spray water circuits for the individual cutting drums.

In a preferred configuration, the spray system has a first spray water circuit for the one cutting drum and a separate second spray water system for the other cutting drum, wherein the cooling water can be fed or is fed to the cutting drums, via the one respective or via the at least one respective control valve connected to the feed lines, as an additional volume of spray water with control valves open and valves open or solely as spray water with valves closed and control valves open. By the division of the fed water into separate spray water circuits for both cutting drums and by connecting the water from the cooling water circuits to the system as and when required, considerably more effective spraying optimized with regard to water consumption control can be realized. It may suffice to arrange in each case precisely one valve and one control valve for each sub-circuit in the spray water circuit and/or in the cooling water circuit in order to be able to carry out the spraying optionally only with cooling water, only with spray water or with the volumetric flows of cooling water and spray water.

According to a further configuration, at least two valves which can be activated independently of one another can be arranged between the water connection, in particular between the associated branch line of the spray water sub-circuit, and the respective feed line in the spray water circuit for each cutting drum, and/or at least two control valves which can be activated independently of one another can be arranged for each cutting drum between the return line and the respective feed line to the cutting drum in the cooling water circuit. By separate activation of the respective control valves and valves, not only can the volume of water for the spraying then actually fed to the cutting drums be set differently for the individual cutting drums, but the volume can also be adapted gradually to the requirements, with little outlay in terms of circuitry, in order to spray only the water volume required for dust control at the longwall, while the rest of the water is directed away from the longwall again via the return lines and a return hose. For further optimization and improvement in effectiveness, a volume regulating valve can be assigned to each valve in the spray water circuit.

Furthermore, in order to increase safety at the longwall, a branch to an extinguishing spray system which can preferably be switched on manually can preferably be arranged in the water circuit. Alternatively or additionally, a branch leading into a camera cleaning system which can be switched on and off and is intended for cleaning, for example, a monitoring camera for the longwall or the shearer loader can be arranged downstream of the pressure limiting valve.

These and other objects, aspects, features and advantages of the invention will become apparent to those skilled in the art upon a reading of the Detailed Description of embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figures 1, 2:
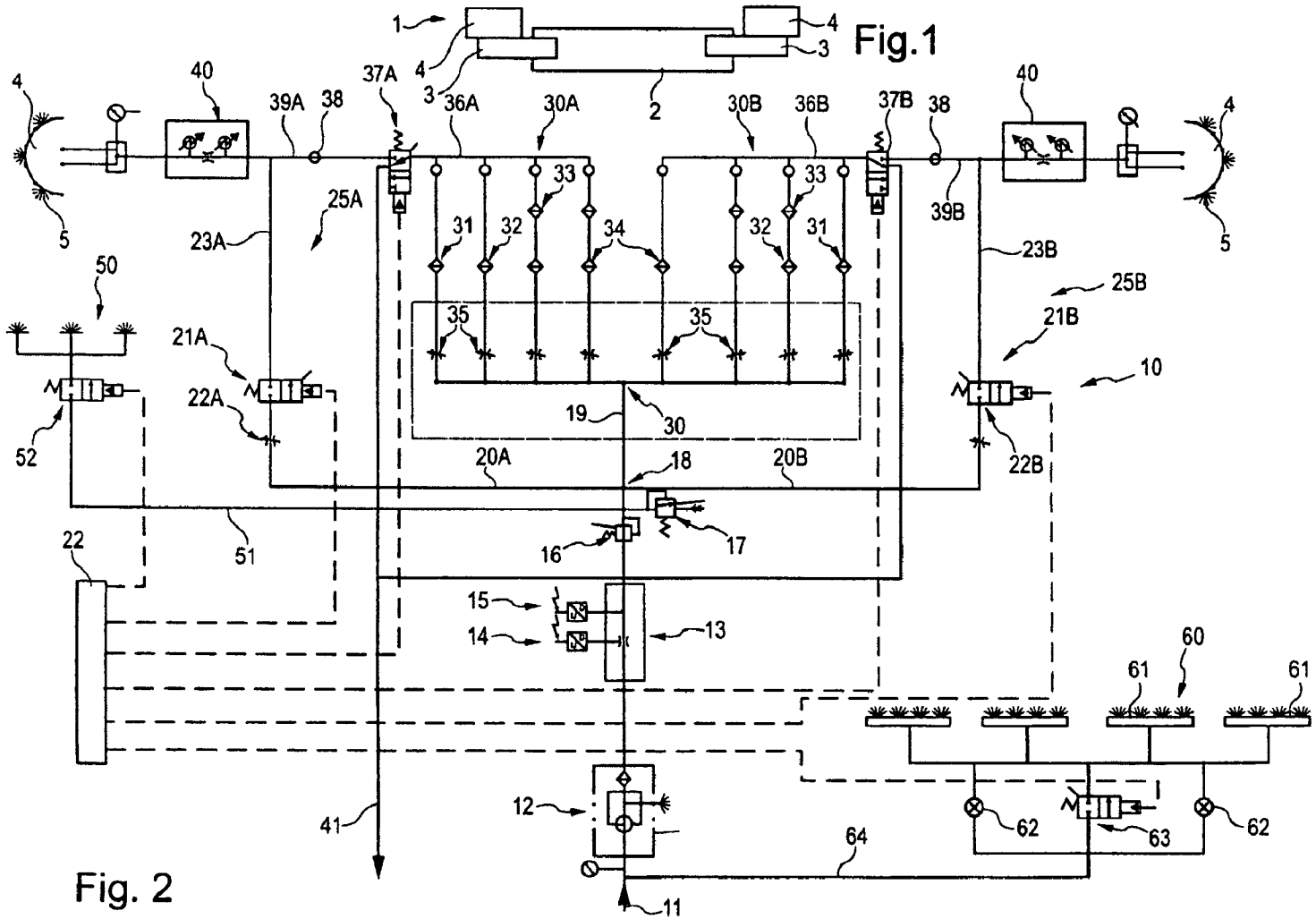
FIG. 1 shows a highly schematic simplified plan view of a shearer loader for underground mining.
FIG. 2 shows a diagram of the water circuits, provided in a shearer loader according to the invention in FIG. 1, for the cooling and spraying according a first exemplary embodiment.

Referring now to the drawings wherein the showings are for the purpose of illustrating preferred and alternative embodiments of the invention only and not for the purpose of limiting same, A shearer loader 1, in particular for coal winning in underground mining, is shown in FIG. 1 in a highly schematic simplified manner, said shearer loader 1 having a shearer loader body 2 which is movable on a rack laid parallel to the conveyor (not shown) at the longwall. Fastened to the shearer loader body 2 for both directions of travel of the shearer loader 1 are respective supporting arms 3, on which in turn a cutting drum 4 is rotatably mounted for each direction of travel, said cutting drum 4 being fitted with a multiplicity of cutter picks (not shown) as processing tools, with which the minerals to be worked, such as coal in particular, are won at the working face. Water circulation systems (not shown in FIG. 1) inter alia with a cooling water circuit for the drive systems of the individual units and motors of the shearer loader and also a spray system for the cutting drums 4 are integrated in the shearer loader body 2, in the supporting arms 3 and in the cutting drums 4, the construction of which water circulation systems will now be explained with reference to FIG. 2.

Of the shearer loader, only the two cutting drums 4 for the respective directions of travel are indicated in FIG. 2, where it can be seen in the schematic illustration according to FIG. 2 that both cutting drums 4 are provided with a multiplicity of nozzles 5 which are preferably assigned directly to the processing tools and via which the spray water for dust suppression is sprayed out during the winning. In order to supply the nozzles 5 with spray water, water is fed to the shearer loader via at least one hose, which is preferably laid parallel to the trailing cable for the electrical power supply of all the units of the shearer loader, this water being fed via an inlet 11 common to all the water circuits 10. This may preferably involve a low-pressure input for water at an average pressure of about 35-40 bar with a flow rate of, for example, about 300 l/min. Arranged downstream of the water inlet 11 in the water circuit 10 is a reversible flow filter 12, via which impurities in the fed water can be filtered out in order to prevent contaminants in the water from leading to blockages in the sub-circuits or to blockages of the nozzles. Connected in turn downstream of the reversible flow filter 12 in the water circuit 10 is a combined flow-rate/water-pressure monitoring system 13 which comprises a flow sensor 14 and a pressure sensor 15 in order to determine the current pressure P and the current flow rate Q and to signal them via signal lines (not shown) to a primary controlling and evaluating device (likewise not shown). A pressure regulating valve 16 with downstream pressure limiting valve 17 with which the pressure of the water can be regulated to the desired range, here between 35 bar and 40 bar, are arranged downstream of the monitoring system 13.

Arranged downstream of the two valves 16, 17 is a flow branch point or a flow divider 18, from which a line branch 19 leads to a cooling circuit 30 and two further branch lines 20A and 20B lead to a respective control valve 21A, 21B, which can be connected to a common pilot control block 22 by actuating electromagnetic valves in order to feed the spray water as and when required either to the one cutting drum 4 via the branch line 20A with valve 21A open or to the other cutting drum 4 via the other branch line 20B with valve 21B open. Connected upstream of both valves 21A, 21B is a respective volume regulating valve 22A, 22B in order to be able to reduce to a suitable value the volume of spray water which is fed to the respective cutting drum 4 via the feed lines 23A and 23B, respectively, with control valve 21A, 21B open. Here, the volume can be limited to, for example, 45 liters/min at most. The branch point 18 therefore divides the water fed via the inlet 11 in each case into a separate spray water circuit 25A for the one cutting drum and a separate spray water circuit 25B for the other cutting drum 4, wherein, depending on the ventilating direction or on account of other conditions, the flow rate of the spray water can be set differently via the spray circuits 25A, 25B.

The branch line 19 downstream of the branch point 18 opens into the cooling water circuit, which is designated overall by 30 and which may in turn comprise sub-circuits 30A for the one cutting drum 4 and 30B for the other cutting drum 4. Each sub-circuit 30A, 30B can be provided with a plurality of cooling units, for example for cutting drum drive motors 31, winch drive motors 32 for the respective direction of travel, driving motors 33 for the supporting arms and for other system components to be cooled 34, such as pumps, etc. A volume regulating valve 35, via which the respectively fed volume of cooling water can be set individually, can be assigned to every individual drive motor 31, 32, 33 or to every individual system component 34 to be cooled. The cooling water from the cooling water circuit 30A can be fed via a return line 36A and the cooling water of the cooling water circuit 30B can be fed via a return line 36B to a common return hose 41, via which cooling water no longer required can be directed away from the longwall. Assigned to both return lines 36A, 36B is a respective control valve 37A, 37B which, via an intermediate line 39A, 39B protected by means of a check valve 38, opens into one of the feed lines 23A, 23B to the cutting drums 4 in order to enable the cooling water to be fed from the respective cooling water circuit 30A or 30B to the associated cutting drum 4 as and when required. Therefore, by opening the control valves 37A and 37B, respectively, with valves 21A, 21B in the spray circuits 25A, 25B open, the volume of spray water fed to the respective cutting drums 4 can be increased by the volume of cooling water, or the spraying, by simultaneously closing the valves 21A, 21B, can be effected if need be solely with the cooling water used beforehand for the cooling. Metered feeding of spray water or cooling water to the cutting drums 4 can be achieved by suitable activation of the volume regulating valves and of the control valves. The additional water volume from the cooling water circuit 30A or 30B can be fed to the cutting drums 4 even when, for example, the pressure-difference measuring system 40 assigned to the respective cutting drums 4 indicate an increase in the differential pressure and thus clogging of the nozzles in the cutting drums 4.

Furthermore, in the exemplary embodiment shown, the water circuit 10 comprises a camera cleaning system 50, which can be actuated via a branch line 51 and a valve 52 in order to be able to clean, for example, the lenses of monitoring cameras, and a fire extinguishing spray system 60 having a plurality of nozzle groups 61 which are assigned to the cutting motors and the shearer loader body. The fire extinguishing system 60 is actuated manually via manual control valves 62 and a pilot-controlled valve 63, and the extinguishing system 60 is connected directly to the water inlet 11 upstream of the reversible flow filter 12 via the branch line 64.

Figure 3:
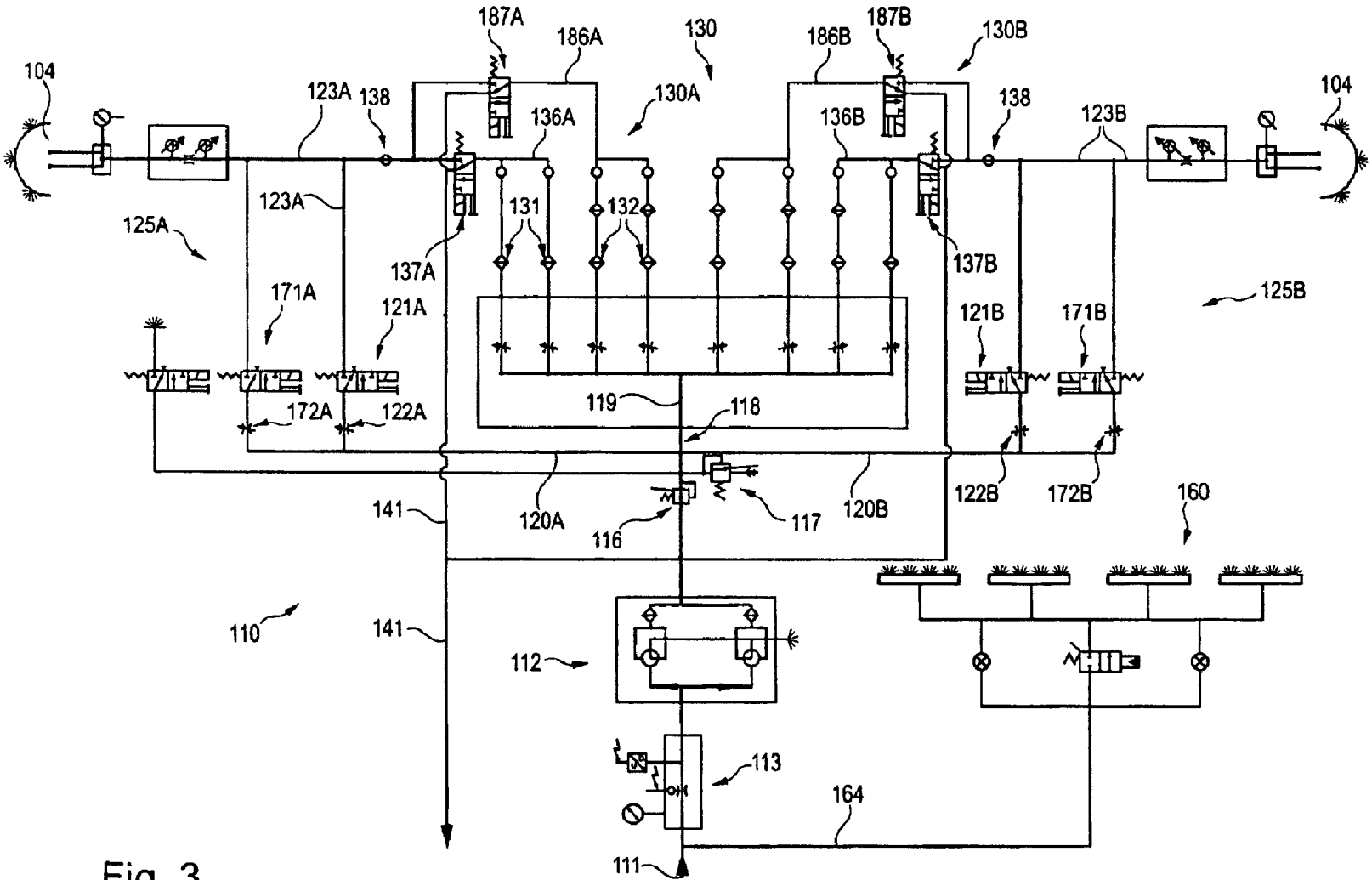
FIG. 3 shows a diagram of the water circuits for the cooling and spraying according to a second exemplary embodiment.

FIG. 3 shows, in a second hydraulic plan, an alternative exemplary embodiment for the configuration of the water circuit for a combined spray and cooling system in a shearer loader according to FIG. 1. Of the shearer loader, only the two cutting drums 104 with the plurality of nozzles are shown in FIG. 3. The water is supplied to all the water circuits 110, as in the previous exemplary embodiment, via a central water inlet 111, of which a branch line 164 leads to a preferably manually actuable fire extinguishing system 160, whereas the main volume of water here first flows to a flow-rate/water-pressure monitoring system 113 and then to a double reversible flow filter 112 and from there via a pressure regulating device 116 and a pressure limiting device 117, as in the previous exemplary embodiment, to a main branch point 118. As in the previous exemplary embodiment, the volume of water at the main branch point 118 is fed via a branch line 119 to a cooling water circuit which is designated overall by reference numeral 130 and which here again has two cooling water sub-circuits 130A, 130B. However, subgroups are in turn formed in each of the two sub-circuits 130A and 130B in order to feed the cooling water volumetric flow of the two cooling units 131, e.g. drive motors, to a first control valve 137A via a first return line 136A and the cooling water volumetric flow of the units designated by reference numeral 132 to a second control valve 187A via a return line 186A. An identical construction is found in the second sub-circuit 1308 of the cooling water circuit having the control valve 137B in the return line 136B and the control valve 187B in the return line 186B. In the initial position, all the control valves 137A, 137B, 187A, 187B are operated in such a way that the water flows from the individual return lines 136A, 136B, 186A, 186B to the return hose 141 and can be conducted away from the shearer loader or the longwall. However, each individual control valve 137A, 187A, 137B, 187B can also be operated—if need be independently of all the other control valves and valves—in such a way that the respective water volumetric flow flows from the associated return line, e.g. 136A at the control valve 137A, not to the return hose 141 but rather to the feed line 123A (or 123B in the cooling water circuit 130B) to one of the two cutting drums 104. The inflow to the feed lines 123A, 123B is in this case effected downstream, i.e. downstream of the valves of the spray water circuits, via intermediate lines which are protected by means of check valves 138.

In the exemplary embodiment shown, the spray water circuit is also divided into two separate spray water circuits, namely into the spray water circuit 125A for the cutting drum 104 shown on the left in FIG. 3 and into the spray water circuit 125B for the cutting drum 104 shown on the right in FIG. 3. The volumetric flow is divided at the main branch point 118 via the branch lines 120A and 120B, respectively. In deviation from the first exemplary embodiment, two valves 121A, 171 A which can be activated separately and have volume regulating valves 122A, 172A connected upstream are now arranged in the branch line 120A for the spray water circuit 125A, and two valves 121B, 171B having volume regulating valves 122B, 1728 connected upstream are also arranged in the branch line 120B for the spray water circuit 125B, in order to be able to set the volume of spray water differently in each spray water circuit 125A, 125B by opening or closing one or both associated control valves 121A, 171A. The inflow from the cooling circuits is effected downstream, i.e. downstream of the valves 121A, 121B, 171A, 171B of the spray water circuits 125A, 125B, via the intermediate lines protected by means of check valves 138. Since both the valves 121A, 171A and the control valves 137A, 187A can be operated independently of one another via a control device (not shown here), there are, in the exemplary embodiment according to FIG. 3, already various adjusting means for the volume of spray water for the cutting drum 104 in the left-hand sub-circuit 16 identified by "A" in each case. The same applies of course to the right-hand cutting drum 104 downstream of the spray water circuit 125B and the cooling water sub-circuit 130B. In the second exemplary embodiment, the spray water can originate solely or partly from the associated spray water circuit 125A or 125B, solely or partly from the cooling water circuit 130A, 130B or from both sub-circuits. The adjusting means for optimizing the spray water ultimately fed to the cutting drums 104 can be set even more precisely by the arrangement of further control valves or valves. Since the control valves of the cooling water circuit have a connection to the return line 141, it can be ensured at the same time that water temporarily not required for spraying can be directed away from the shearer loader again and thus from the longwall.

For the person skilled in the art, numerous modifications which are to come within the scope of protection of the appended claims emerge from the above description. It goes without saying that the system can also work at other pressures and that there may also be additional volume regulating valves, for example, in the intermediate lines in order to be able to regulate the volume of spray water fed to the cutting drums in an even more optimum manner. The number of valves and control valves present in each circuit or sub-circuit may vary and separate control valves could also be provided, for example, for each line branch in the cooling water circuit, said control valves interacting with a single valve or even with more than two valves in the spray water circuit in order to be able to set, as and when required, the admission of water to the individual cutting drums by separate activation of the valves and control valves.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A shearer loader for underground mining, comprising a shearer loader body, a respective cutting drum fastened to a supporting arm for each direction of travel of the shearer loader, drive motors for moving the shearer loader and the cutting drums, a cooling water circuit for cooling the drive motors, a spray system which includes at least one spray water circuit having a respective feed line to the tools of the cutting drums, a common water connection for the water circuits, and valves assigned to the water circuits for switching the circuits on or off, the loader further including a respective control valve connected to one of the feed lines and is arranged in return lines of the cooling water circuit, via the control valve the cooling water can be fed as spray water to the cutting drums as and when required.

2. The shearer loader as claimed in claim 1, wherein the control valve includes a separate control valve for each cutting drum.

3. The shearer loader as claimed in claim 2 wherein the control valves are each connected via an intermediate line to the associated feed line for one of the cutting drums, each feed line being provided, upstream of the inflow to the intermediate line with the valve for switching on and off and with a volume regulating valve.

4. The shearer loader as claimed in claim 1 further including volume regulating valves arranged in one of an intermediate lines and a cooling water feed line of at least one drive motor.

5. The shearer loader as claimed in claim 4 wherein some or all of the volume regulating valves can be activated or regulated for metered admission of spray water to the cutting drum.

6. The shearer loader as claimed in claim 1 further including at least one of a pressure limiting and a pressure regulating valve which is arranged downstream of the water connection in the common water feed to both circuits.

7. The shearer loader as claimed in claim 6 further including a volumetric flow sensor arranged upstream of the pressure limiting valve.

8. The shearer loader as claimed in claim 7 further including a water filter arranged in the water feed upstream of the volumetric flow sensor.

9. The shearer loader as claimed in claim 8 wherein the water filter is a reversible flow filter.

10. The shearer loader as claimed in claim 6 further including a branch point downstream of the pressure limiting valve, the branch point opening with first branch lines into spray water circuits for each cutting drum and with a further branch into the cooling water circuit.

11. The shearer loader as claimed in claim 6 further including a branch leading into a camera cleaning system which can be switched on and off and which is arranged downstream of the pressure limiting valve.

12. The shearer loader as claimed in claim 1 wherein the drum is a first and second drum and the spray system includes a first and a second spray water circuit, the first spray circuit being joined to the first drum and the second spray circuit being joined to the second drum, the control valve being a first and a second control valve joined to said first and second spray water circuit respectively.

13. The shearer loader as claimed in claim 1 wherein at least two valves which can be activated independently of one another are arranged between the water connection and the respective feed line in the spray water circuit for each cutting drum.

14. The shearer loader as claimed in claim 1 wherein at least two control valves which can be activated independently of one another are arranged between the return line and the respective feed line in the cooling water circuit for each cutting drum.

15. The shearer loader as claimed in claim 13 further including a volume regulating valve assigned to each valve in the spray water circuit.

16. The shearer loader as claimed in claim 1 further including a branch to a fire-extinguishing spray system which can be switched on manually is arranged in the water circuit.

17. The shearer loader as claimed in claim 1 wherein the drum is a first and second drum and the spray system includes a first and a second spray water circuit, the first spray circuit being joined to the first drum and the second spray circuit being joined to the second drum, the control valve being a first and a second control valve joined to said first and second spray water circuit respectively, when the loader is in an additional volume condition, the first and second control valves being in an opened position and the valves in the feed lines being in an opened position wherein a flow of the cooling water can be fed to at least one of the first and second cutting drums via at least one of the first and second control valves connected to the feed lines as an additional volume of spray water to the at least one first and second drum.

18. The shearer loader as claimed in claim 1 wherein the drum is a first and second drum and the spray system includes a first and a second spray water circuit, the first spray circuit being joined to the first drum and the second spray circuit being joined to the second drum, the control valve being a first and a second control valve joined to said first and second spray water circuit respectively, when the loader is in a cooling water spray condition, the first and second control valves being in an opened position and the valves in the feed lines being in a closed position wherein a flow of the cooling water can be fed to at least one of the first and second cutting drums via at least one of the first and second control valves connected to the feed lines as a primary volume of spray water to the at least one first and second drum.

19. The shearer loader as claimed in claim 13 wherein the drum is a first and second drum and the spray system includes a first and a second spray water circuit, the first spray circuit being joined to the first drum and the second spray circuit being joined to the second drum, the control valve being a first and a second control valve joined to said first and second spray water circuit respectively, when the loader is in an additional volume condition, the first and second control valves being in an opened position and the valves in the feed lines being in an opened position wherein a flow of the cooling water can be fed to at least one of the first and second cutting drums via at least one of the first and second control valves as an additional volume of spray water to the at least one first and second drum.

20. The shearer loader as claimed in claim 13 wherein the drum is a first and second drum and the spray system includes a first and a second spray water circuit, the first spray circuit being joined to the first drum and the second spray circuit being joined to the second drum, the control valve being a first and a second control valve joined to said first and second spray water circuit respectively, when the loader is in a cooling water spray condition, the first and second control valves being in an opened position and the valves in the feed lines being in a closed position wherein a flow of the cooling water can be fed to at least one of the first and second cutting drums via at least one of the first and second control valves as a primary volume of spray water to the at least one first and second drum.

21. A shearer loader for underground mining, comprising a shearer loader body and a first and a second cutting drum fastened to at least one supporting arm for each direction of travel of the shearer loader, the loader further including drive motors for moving the loader and the first and second cutting drums, water circuits including a cooling water circuit for cooling the drive motors which have return lines and a spray system which includes a first spray water circuit having a first feed line and a first feed valve in fluid connection with the first cutting drum and a second spray water circuit having a second feed line and a second feed valve in fluid connection with the second cutting drum, the water circuits having a common water connection and the first and second feed valves allowing the switching of the first and second circuits on or off, the loader further including a first control valve in fluid connection with both the first feed line and one of the return lines of the cooling water circuit and a second control valve in fluid connection with both the second feed line and another one of the return lines of the cooling water circuit, the first and second control valves allowing a flow of cooling water in the cooling water circuit to be directed to the respective feed line and fed as spray water to at least one of the first and second cutting drums as and when required.

22. The shearer loader as claimed in claim 21 wherein when the loader is in an additional volume condition, at least one of the first and second control valves is in an opened position and at least one of the feed valves is in an opened position such that a flow of the cooling water can be fed to at least one of the first and second cutting drums via the at least one of the first and second control valves as an additional volume of spray water to the at least one drum.

23. The shearer loader as claimed in claim 21 wherein when the loader is in a cooling water spray condition, at least one of the first and second control valves is in an opened position and at least one of the feed valves is in a closed position such that a flow of the cooling water can be fed to at least one of the first and second cutting drums via at least one of the first and second control valves as a primary volume of spray water to the at least one first and second drum.

24. A shearer loader for underground mining, the shearer loader comprising a shearer loader body, at least one cutting drum fastened to a supporting arm joined to the loader body, a first drive motor for moving the shearer loader and a second drive motor for moving the cutting drums, a cooling water circuit for cooling the first and second drive motors, the cooling water circuit including an inlet and a return line, a spray system including at least one spray water circuit, the spray system including a feed line fluidly connecting a common water connection to the cutting drums, the spray system further including a valve in the feed line for switching the spray water circuits on and off, a control valve connected between the feed line of the spray water circuit and the return line of the cooling water circuit, the control valve allowing selective flow from the cooling water circuit to be directed to the cutting drums.

* * * * *